United States Patent [19]

Hammer et al.

[11] Patent Number: 4,914,354

[45] Date of Patent: Apr. 3, 1990

[54] REACTOR-TYPE BALLAST CIRCUIT

[75] Inventors: Edward E. Hammer, Mayfield Village; Eugene Lemmers, Cleveland Hts., both of Ohio

[73] Assignee: General Electric Company, Schenectady, N.Y.

[21] Appl. No.: 241,991

[22] Filed: Sep. 8, 1988

[51] Int. Cl.[4] ..... H05B 41/16

[52] U.S. Cl. ..... 315/247; 315/97; 315/104; 315/245; 315/290; 315/DIG. 5

[58] Field of Search ..... 315/94, 95, 97, 102, 315/103, 104, 105, 106, 107, 243, 245, 247, 290, DIG. 5

[56] References Cited

U.S. PATENT DOCUMENTS

| | | | |
|---|---|---|---|
| 2,299,499 | 10/1942 | Sanford | 315/107 X |
| 2,309,874 | 2/1943 | Somers | 176/124 |
| 2,361,017 | 10/1944 | Flick et al. | 315/98 |
| 2,424,505 | 7/1947 | Rupersburg | 315/96 |
| 2,479,173 | 8/1949 | Lemmers | 315/99 |
| 2,740,861 | 4/1956 | Lake | 200/113.5 |
| 2,901,653 | 8/1959 | Gilmore | 313/109 |
| 2,928,990 | 3/1960 | Siljeholm et al. | 315/97 |
| 2,938,146 | 5/1960 | Muller | 315/107 X |
| 2,963,623 | 12/1960 | Cornell | 315/100 |
| 3,178,610 | 4/1965 | Moerkens et al. | 315/244 |
| 3,991,340 | 11/1976 | Ichinose et al. | 315/106 |
| 4,017,761 | 4/1977 | Woldring | 315/106 X |
| 4,208,616 | 6/1980 | Moerkens | 315/DIG. 5 X |
| 4,366,416 | 12/1982 | Yokoyama | 315/DIG. 5 X |
| 4,388,564 | 6/1983 | Hammer | 315/245 X |
| 4,562,381 | 12/1985 | Hammer et al. | 315/99 |
| 4,588,925 | 5/1986 | Fahnrich et al. | 315/107 X |

*Primary Examiner*—David Mis

*Attorney, Agent, or Firm*—John P. McMahon; Stanley C. Corwin; Charles L. Moore, Jr.

[57] ABSTRACT

An improved, more energy efficient reactor-type ballasting circuit for fluorescent lamps includes an inductive ballasting coil for directly applying an AC line voltage to the cathodes of a lamp without an intermediate autotransformer and also includes a glow type thermal switch in series with a positive temperature coefficient (PTC) resistor for electrical connection across the cathodes of the lamp to conduct pre-heating current to the lamp cathodes. The PTC resistor will effectively remove the glow switch from the ballast circuit if the switch fails to open after an appropriate time delay.

8 Claims, 3 Drawing Sheets

REACTOR-TYPE BALLAST CIRCUIT

BACKGROUND OF THE INVENTION

The present invention relates to ballast circuits for starting gas discharge lamps, and, more particularly, to an improved ballast circuit of the reactor type.

Conventional fluorescent lamp ballasting circuits typically include an autotransformer to produce a voltage of sufficient amplitude between the cathodes of a fluorescent lamp to produce an arc therebetween in order to start the lamp and cause it to remain illuminated. The primary winding of an autotransformer, however, has a coil resistance that results in a loss of electrical energy. Therefore, if the autotransformer can be eliminated from the ballast circuit, the efficiency of the ballast would be greatly increased. Furthermore, the autotransformer represents a significant expense item in the production of conventional ballast circuits.

A reactor technology-type of ballast circuit having the line voltage directly connected to an inductive ballasting coil without an intermediate autotransformer may be used to start and sustain illumination of a fluorescent lamp if the lamp is capable of operating at voltages slightly below the line voltage (i.e. the lamp is rated to operate at a voltage within about 65% of the expected line voltage). Because of the higher line voltages involved, reactor technology ballasts of this type are generally only recommended for use with biaxial-shaped and circular-shaped lamps which have their end cathodes proximate to each other, such as the Biax TM and Mod-U-Line TM family of lamps as manufactured by the General Electric Company, Cleveland, Ohio.

Conventional ballast circuits also usually provide an arrangement for supplying pre-heating current to the lamp cathodes. Pre-heating the lamp cathodes prevents "sputtering" which is erosion of the cathode metal each time an arc is generated to start the lamp when the cathodes are not pre-heated to an adequate thermionic temperature. A method of providing cathode pre-heat current is to electrically connect a glow type thermal switch between the lamp cathodes. The glow switch produces a glow discharge to heat the switch's thermally responsive contacts which then close to conduct heating current to the lapp cathodes when line voltage is initially applied to the ballast circuit as described in U.S. Pat. No. 2,740,861 to Lake. The switch glow discharge path is shunted when the switch contacts make, and heat is no longer generated to hold the contacts closed. After a time delay, the contacts should cool and open to start the lamp, but on occasion have been known to remain closed ballast to overheat and become a potential overheating hazard.

Conventional ballast circuits also usually have a power factor correction capacitor in series with one of the inductive ballasting coils to reduce the energy consumption of the ballast circuit during operation of the lamp. Prior to lamp starting, however, the capacitor can prevent the lamp in an electrical path with it from receiving a sufficient level of cathode pre-heat current. Thus, the lamp can be started before the lamp's cathodes have reached an adequate thermionic temperature and sputtering can result, thereby shorten the lamp's serviceable life.

It is accordingly an object of the present invention to provide an improved ballast circuit which is not subject to the foregoing disadvantages.

It is another object of the present invention to provide an improved, more energy efficient reactor-type ballast circuit for a fluorescent lamp.

Another objective is to provide a ballast circuit of the above character, which is simple in construction, inexpensive to manufacture, and reliable over a long service life.

Other objects of the invention will in part be obvious and in part appear hereinafter.

SUMMARY OF THE INVENTION

In accordance with the present invention there is provided an improved reactor-type ballast circuit for a fluorescent lamp of the type having a cathode disposed at each end thereof. The improved ballast circuit includes an inductive ballasting coil for connection in series with the lamp across a pair of input terminals. A switch is provided for electrical connection between the cathodes of the lamp. The switch is operable to close when line voltage is applied across the input terminals to conduct pre-heating current to the cathodes before the lamp is started and to open after an appropriate time delay. The ballasting coil induces a high voltage pulse across the lamp cathodes to start the lamp in response to the opening o the switch.

In accordance with the present invention, a device is connected in circuit with the switch for effectively removing the switch from the ballast circuit in the event the switch fails to open upon expiration of the time delay.

DESCRIPTION OF THE DRAWINGS

Like reference numerals refer to corresponding parts throughout the several figures of the drawings.

DETAILED DESCRIPTION OF THE PREFERRED EMBODIMENT

Figure 1:
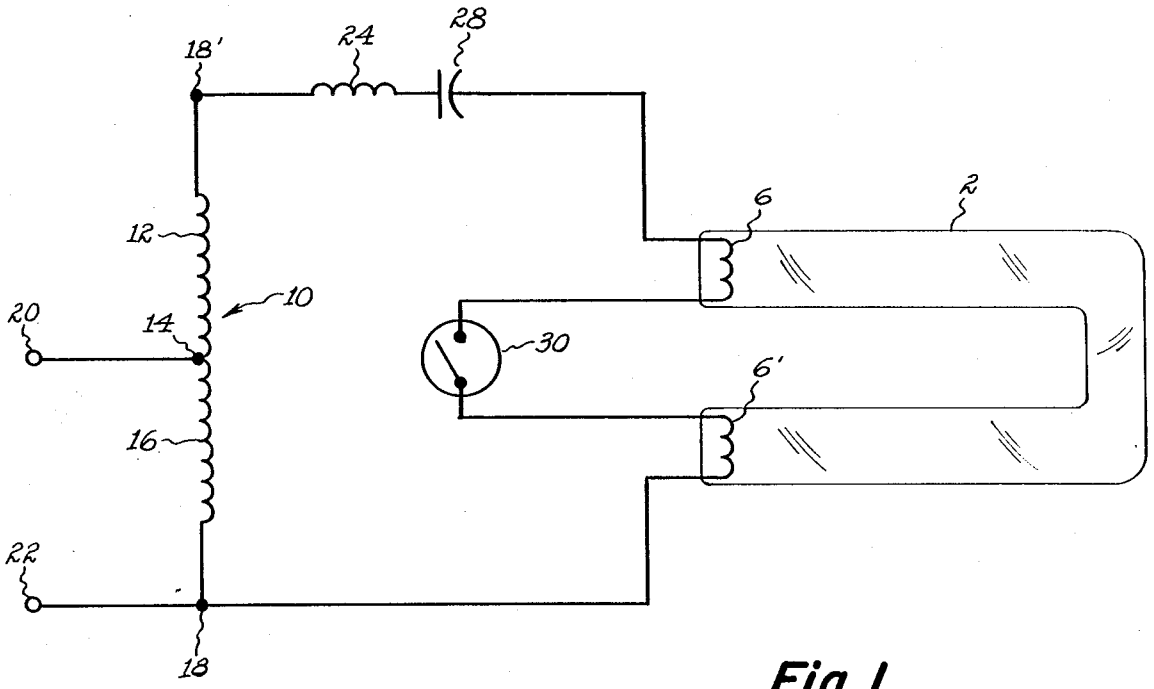
Fig. 1 (PRIOR ART)
FIG. 1 is a schematic diagram of a conventional prior art ballast circuit.

Referring now in greater detail to the accompanying drawings and initially to FIG. 1, wherein there is illustrated a typical prior art ballast circuit for operating a single fluorescent lamp 2 having a pair of cathodes 6 and 6', respectively, one at each of the opposite ends of the lamp.

The ballast circuit includes a ballasting autotransformer, indicated generally at 10, having a secondary winding 12, which is tapped, as indicated at 14, to provide a primary winding section 16 between the tap and a common transformer terminal 18. The primary winding section 16 has input terminals 20 and 22 respectively connected to tap 14 and transformer terminal 18 for the application of AC line voltage thereacross. The secondary winding 12 has a pair of output terminals 18 and 18' across which a stepped up AC voltage is developed. Output terminal 18 is connected to cathode 6' of lamp 2, and output terminal 18' is connected to one end of an inductive ballasting coil 24. The other end of inductive ballasting coil 24 is connected to cathode 6 of lamp 2 through a power factor correction capacitor 28. A time delay switch 30, connected across cathodes 6 and 6', operates to close when line voltage is applied across input terminals 20 and 22 to conduct pre-heating current to cathodes 6 and 6'. After an appropriate time delay during which cathodes 6 and 6' will have been heated to an adequate thermionic temperature, switch 30 opens. This interruption of heating current flow causes coil 24 to develop a high voltage pulse across cathodes 6 and 6' to start lamp 2.

Figure 2:
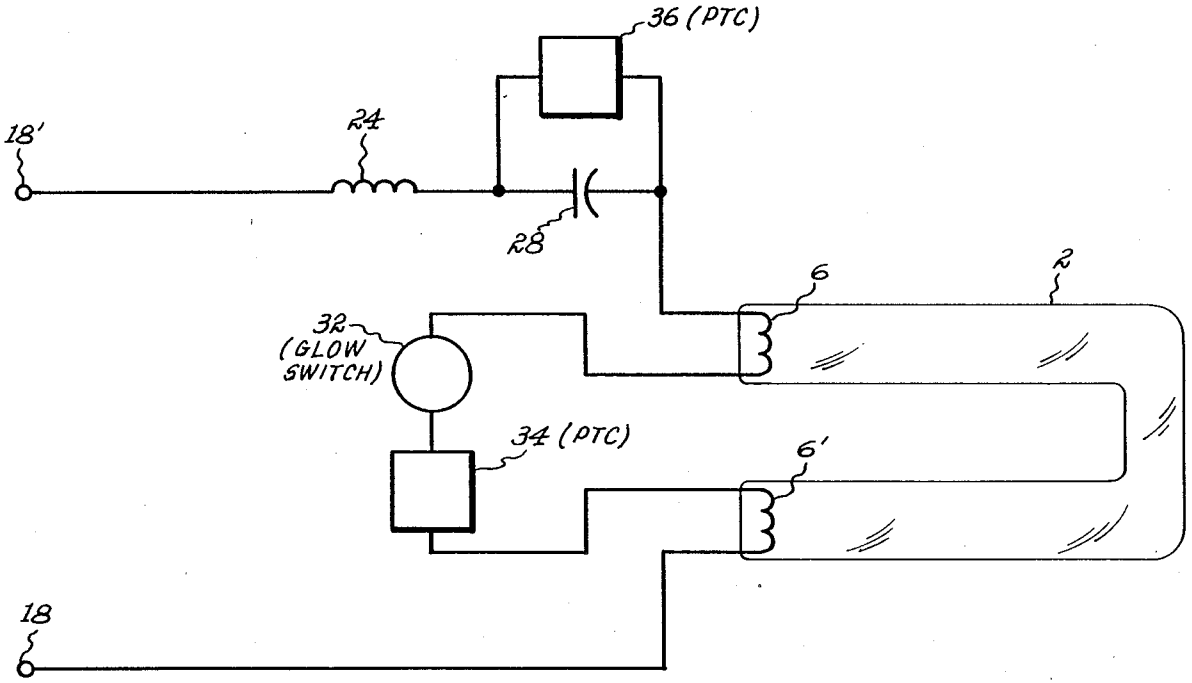
FIG. 2 is a schematic diagram of an improved ballast circuit for a single fluorescent lamp constructed in accordance with an embodiment of the present invention.

FIG. 2 shows a reactor technology-type ballast circuit according to the present invention, wherein the autotransformer has been eliminated from the ballast circuit. This is possible if the line voltage is sufficiently high such that the rating of lamp 2 is about 65% of the expected AC line voltage, i.e. lamp 2 is capable of operation at a voltage within about 65% of the line voltage.

According to the ballast circuit of the present invention shown in FIG. 2, a conventional glow type thermal switch 32 in series with a positive temperature coefficient (PTC) resistor 34 is provided for connection across the lamp cathodes 6 and 6'. The ionizable gas in glow switch 32 will ionize producing a glow discharge to heat the thermally responsive contacts of the switch when line voltage is initially applied across input terminals 18 and 18'. The heat will distort the contacts into a closed position to conduct pre-heating current through lamp cathodes 6 and 6'. When the switch contacts are closed, the glow discharge path of ionized gas is shorted, and heat is no longer generated to hold the contacts closed. Therefore, after an appropriate time delay, the contacts will cool and return to their normally open position. With the interruption of cathode pre-heating current, ballasting coil 24 will induce a high voltage pulse across lamp cathodes 6 and 6' to star lamp 2 in a well known manner. If the contacts of glow switch 32 should fail to open to start lamp 2, PTC resistor 34 will increase in resistance during a relatively short time period as it conducts current to a magnitude sufficient to limit current flow to a minimal, safe level. In this manner, PTC resistor 34 effectively removes glow switch 32 from the ballast circuit to prevent the circuit from overheating and becoming a fire hazard.

Further, in accordance with the present invention, another positive temperature coefficient (PTC) resistor 36 is connected in parallel with power factor correction capacitor 28. In operation, PTC resistor 36 represents a very low resistance verging on a short circuit when line voltage is initially applied to input terminals 18 and 18'. Thus, cathode preheating current is permitted to bypass capacitor 28 without being limited thereby. PTC resistor 36 will, however, increase in resistance as it conducts current until the resistance reaches a magnitude where it effectively looks like an open circuit as compared to capacitor 28. Therefore, after a short time delay from when voltage is initially applied to terminals 18 and 18' and after lamp 2 starts, capacitor 28 is effectively inserted into the ballast circuit to improve the power consumption of the ballast circuit during lamp operation.

Figure 3:
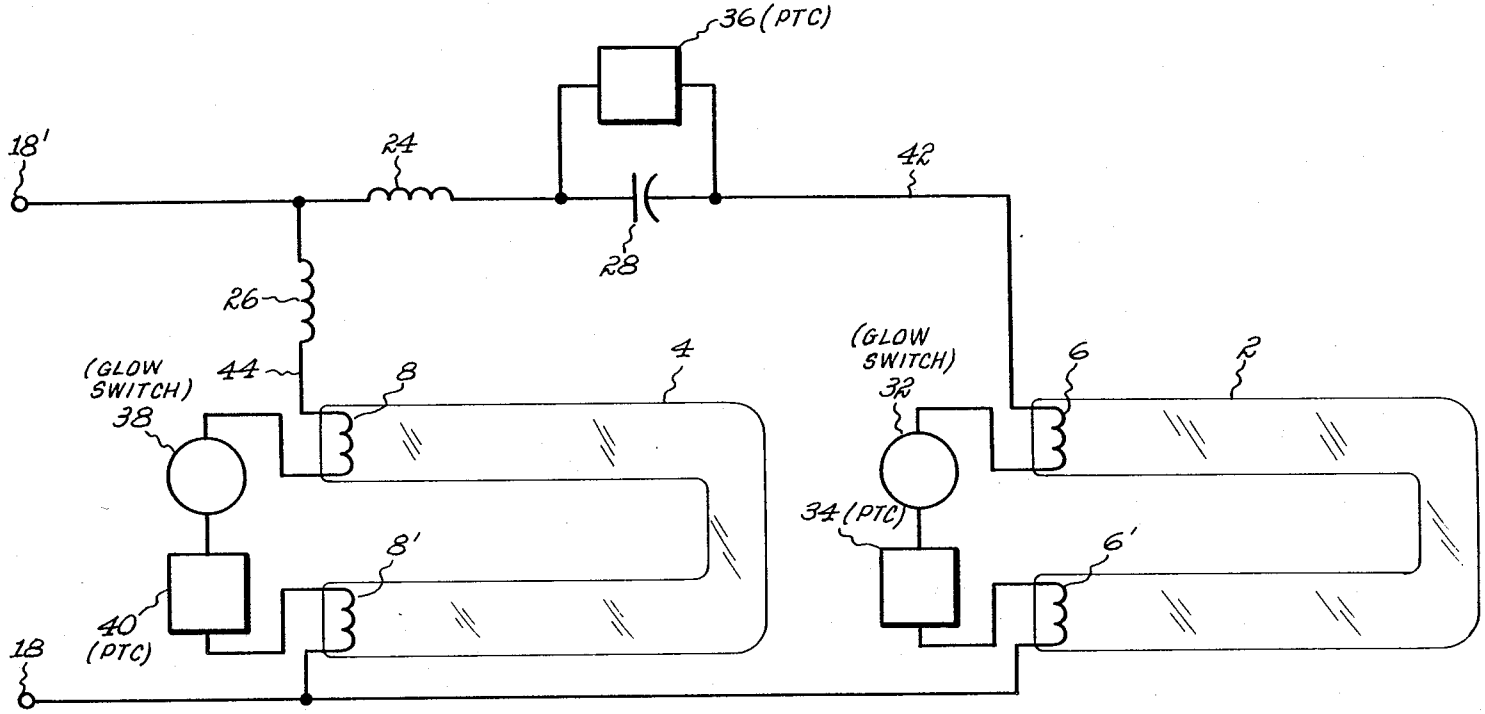
FIG. 3 is a schematic diagram of an improved ballast circuit for a pair of fluorescent lamps constructed in accordance with an alternate embodiment of the present invention.

FIG. 3 shows a reactor technology type ballast circuit according to the present invention for two fluorescent lamps 2 and 4. Input terminals 18 and 18' are provided for applying an AC line voltage to the ballast circuit. Input terminal 18 is electrically connected in parallel to cathode 6' of lamp 2 and to cathode 8' of lamp 4. Input terminal 18' connected in parallel to corresponding one ends of inductive ballasting coils 24 and 26. The other end of inductive ballasting coil 24 is connected to cathode 6 of lamp 2 through power factor correction capacitor 28, and the other end of inductive ballasting coil 26 is connected directly to cathode 8 of lamp 4.

In accordance with the present invention, glow type thermal switch 32 in series with positive temperature coefficient (PTC) resistor 34 are connected across cathode 6 and 6' of lamp 2, and glow type thermal switch 38 in series with positive temperature coefficient (PTC) resistor 40 are connected across cathodes 8 and 8' of lamp 4. Glow switches 32 and 38 close, as previously described, in response to an AC line voltage being applied to input terminals 18 and 18' to conduct preheating current through cathodes 6 and 6' of lamp 2 and through cathodes 8 and 8'of lamp 4 to pre-heat the cathodes to an adequate thermionic temperature before attempting to start the lamps. After a brief time delay, during which the cathodes are pre-heated, glow switches 32 and 38 should open to cause ballasting coils 24 and 26 to generate lamp starting high voltage pulses respectively across the cathodes of lamps 2 and 4. In the event that either one or both of glow switches 32 and 38 fail to open, the corresponding PTC resistor 34 or 40 will continue to conduct current and increase in resistance to a current-limiting magnitude effectively removing the failed glow switch from the ballast circuit, thus to prevent a circuit overheating hazard.

Additionally, in accordance with the present invention, positive temperature coefficient resistor 36 is connected in parallel with capacitor 28 to shunt pre-heating current from capacitor 28 during pre-heating of the cathodes 6, 6' and 8, 8' as previously described.

It is seen that terminal 18', coil 24, capacitor 28, cathode 6, glow switch 32, PTC resistor 34, cathode 6' and terminal 18 constitutes a series circuit 42, while terminal 18', coil 26, cathode 8, glow switch 38, PTC resistor 40, cathode 8' and terminal 18 constitute a series circuit 44. Capacitor 28 is selected such that the phase of the current conducted by circuit 42 will lead the phase of the voltage applied to cathodes 6 and 6' during the steady state operation of lamp 2. Because of ballasting coil 26, the phase of the current conducted by circuit 44 will lag behind the phase of the voltage applied to cathodes 8 and 8' during the steady state operation of lamp 4. Since circuit 42 is a lead circuit and circuit 44 is a lag circuit the two counteract each other for more efficient consumption of power during the steady state operation of lamps 2 and 4.

It is seen from the foregoing that the present invention provides an improved reactor technology type ballast circuit which is energy efficient and simple in construction employing a minimal number of components as compared to the prior art. Furthermore, the present invention overcomes most of the disadvantages of the prior art and is more reliable in operation.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiments, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalence thereof.

Having described the invention what is claimed as new and desired to secure by Letter Patent is:

We claim:

1. An improved reactor type ballast circuit for a plurality of fluorescent lamps, each having a cathode disposed at each end thereof and shaped so that the ends are proximate to each other, said ballast circuit comprising:

a first input terminal and a second input terminal said second terminal serving for electrical connection with one cathode of each lamp;

a plurality of inductive ballasting coils, each having one end electrically connected to said first input terminal and another end for electrical connection respectively to the other cathodes of the lamps;

separate switch means for electrical connection between the lamp cathodes of each lamp, each said switch means operating to close when line voltage is applied across said first and second input terminals to conduct pre-heating current to said cathodes of each lamp before the lamps are started and to open after a time delay; whereby, said ballasting coils respectively induce a high voltage pulse across the cathodes of each lamp to start each lamp in response to said switch means openings;

means for effectively removing each said switch means from said ballast circuit in the event said switch means fails to open upon expiration of said time delay and a power factor correction capacitor connected in series with one of said ballasting coils;

said series connection of said power factor correction capacitor with said one of ballasting coils forming a lead circuit whereas, said other ballasting coil being devoid of any connection to said power factor correction capacitor forming a lag circuit; said lead and lag circuit counteracting each other for more efficient consumption of power of said line voltage during the steady state operation of said plurality of fluorescent lamps.

2. A ballast circuit according to claim 1, wherein each said switch means includes a glow type thermal switch.

3. A ballast circuit according to claim 1, wherein said switch removing means includes a separate positive temperature coefficient resistor connected in series with each said switch means.

4. A ballast circuit according to claim 1, which further includes means for shunting pre-heating current from said capacitor to prevent limitation of said pre-heating current by said capacitor.

5. A ballast circuit according to claim 4, wherein said capacitor shunting means includes a positive temperature coefficient resistor.

6. A ballast circuit according to claim 5, wherein said switch means includes a plurality of glow type thermal switches, one electrically connected between the cathodes of each lamp.

7. A ballast circuit according to claim 6 wherein said switch removing means includes a plurality of positive temperature coefficient resistors, one connected in series with each glow switch.

8. An improved reactor type ballast circuit for a pair of fluorescent lamps, each having a cathode disposed at each end thereof, said ballast circuit comprising:

a first input terminal and a second input terminal, said second terminal serving for electrical connection with one cathode of each lamp;

a first inductive ballasting coil having one end electrically connected to said first input terminal and another end for electrical connection to the other cathode of one lamp of the pair of lamps;

a first glow type thermal switch for electrical connection between the cathodes of the one lamp;

a second inductive ballasting coil having one end electrically connected to said first input terminal and another end for electrical connection to the other cathode of the other lamp;

a second glow type thermal switch for electrical connection between the cathodes of the other lamp, said first and second glow switches operating to close when line voltage is applied across said first and second input terminals to conduct pre-heating current respectively to the cathodes of the pair of lamps and to open after a time delay; whereby, said first and second ballasting coils respectively induce a high voltage pulse across the cathodes of the pair of lamps to start the lamps in response to the opening of said first and second glow switches;

first and second positive temperature coefficient resistors respectively connected in series with said first and second glow switches, said first and second positive temperature coefficient resistors respectively operating to increase in resistance to effectively remove either of said glow switches from said ballast circuit in the event either of said glow switches fails to open upon expiration of said time delay;

a capacitor connected in series with one of said first and second inductive ballasting coils;

a third positive temperature coefficient resistor shunting said capacitor to shunt pre-heating current from said capacitor to prevent limitation of said pre-heating current by said capacitor, said series connection of said power factor correction capacitor with one of said first and second ballasting coils forming a lead circuit, whereas, said other ballasting coil being devoid of any connection to said power factor correction capacitor forming a lag circuit; said lead and lag circuit counteracting each other for more efficient consumption of power of said line voltage during the steady state operation of said pair of fluorescent lamps.

* * * * *